US007677219B2

(12) United States Patent
Komura et al.

(10) Patent No.: US 7,677,219 B2
(45) Date of Patent: Mar. 16, 2010

(54) CYLINDER HEAD

(75) Inventors: Keisuke Komura, Okazaki (JP); Toshihiko Oka, Anjo (JP); Kenichi Morishima, Okazaki (JP); Norio Takayasu, Kyoto (JP)

(73) Assignees: Mitsubishi Jidosha Kogyo Kabushiki Kaisha, Tokyo (JP); Mitsubishi Jidosha Engineering Kabushiki Kaisha, Aichi (JP)

( * ) Notice: Subject to any disclaimer, the term of this patent is extended or adjusted under 35 U.S.C. 154(b) by 119 days.

(21) Appl. No.: 12/143,269

(22) Filed: Jun. 20, 2008

(65) Prior Publication Data

US 2009/0084341 A1 Apr. 2, 2009

(30) Foreign Application Priority Data

Sep. 27, 2007 (JP) ..... P2007-252146

(51) Int. Cl.
*F01F 1/24* (2006.01)

(52) U.S. Cl. ..... 123/193.5; 123/90.27

(58) Field of Classification Search ..... 123/193.5, 123/90.27, 90.33
See application file for complete search history.

(56) References Cited

U.S. PATENT DOCUMENTS 4,951,622 A * 8/1990 Takahashi et al. ..... 123/193.5
5,161,495 A * 11/1992 Saito ..... 123/90.33
5,213,071 A 5/1993 Iwata et al.
6,135,082 A * 10/2000 Stromsky et al. ..... 123/196 M
6,138,631 A * 10/2000 Stromsky et al. ..... 123/193.5

FOREIGN PATENT DOCUMENTS

JP 5-86813 A 4/1993

* cited by examiner

*Primary Examiner*—M. McMahon
(74) *Attorney, Agent, or Firm*—Birch, Stewart, Kolasch & Birch, LLP

(57) ABSTRACT

A cylinder head includes: a bottom wall portion; an outer circumferential wall portion defining inside thereof a space; a longitudinal wall portion extending to define, in the space, an intake side where an intake camshaft is disposed and an exhaust side where an exhaust camshaft is disposed; first lateral wall portions disposed on the intake side, on which first support portions are formed for supporting the intake camshaft thereon; second lateral wall portions disposed on the intake side, on which second support portions are formed for supporting the variable valve actuating units thereon; and third lateral wall portions disposed on the exhaust side, on which third support portions are formed for supporting the exhaust camshaft thereon. The second lateral wall portions are lower than the first lateral wall portions in a height direction from the bottom wall portion. The third lateral wall portions are higher than the second lateral wall portions in the height direction. A face of the bottom wall portion which is disposed on the exhaust side is higher than a face of the bottom wall portion which is disposed on the intake side, in the height direction.

3 Claims, 6 Drawing Sheets

CYLINDER HEAD

This Nonprovisional application claims priority under 35 U.S.C. §119(a) on Patent Application No. 2007-252146 filed in Japan on Sep. 27, 2007, the entire contents of which are hereby incorporated by reference.

BACKGROUND OF THE INVENTION

The present invention relates to a cylinder head of an engine in which variable valve actuating units are disposed on an intake side thereof.

There have been proposed engine cylinder head reinforcement constructions for increasing the rigidity of a cylinder head of an engine so as to withstand explosions occurred within combustion chambers.

In reinforcement constructions of this type, injector holding bosses adapted to hold injectors installed individually for combustion chambers are connected to each other in a longitudinal direction (a direction in which the combustion chambers are aligned) of a cylinder head, and the injector holding bosses lying at both ends are connected to an outer circumferential wall portion of the cylinder head, whereby a reinforcement wall portion is formed where the bosses and the outer circumferential wall portion are connected integrally.

Furthermore, on an intake side of the cylinder head, intake camshaft supporting portions which support thereon an intake camshaft disposed on the intake side and journals of the same camshaft extend in an intake-to-exhaust direction (a direction which intersects the longitudinal direction of the cylinder head at right angles) and are connected to the reinforcement wall portion and the outer circumferential wall portion, whereby reinforcement wall portions are formed. Similarly, also on an exhaust side, exhaust camshaft supporting portions are connected to the reinforcement wall portion made by the injector holding boss portions and the outer circumferential wall portion, whereby reinforcement wall portions are formed.

By this configuration, the rigidity of the cylinder head is increased by the reinforcement wall portions which intersect each other, and additionally, a balance in rigidity is made to be maintained between the intake side and the exhaust side (refer, for example, to JP-A-5-86813).

On the other hand, there are some engines which include variable valve actuating units for adjusting the operations of intake valves in accordance with the running conditions of a vehicle.

For variable valve actuating units to be installed, boss portions where the variable valve actuating units are installed are formed on an intake side of a cylinder head. When the boss portions are formed on the intake side, however, the rigidity of the intake side is increased to be higher than that of an exhaust side of the cylinder head due to the boss portions so formed functioning to reinforce the part in question of the cylinder head. As a result of this, the rigidity of the intake side is made to differ from the rigidity of the exhaust side, and hence, the balance in rigidity is deteriorated.

It is not preferred that the balance in rigidity between the intake side and the exhaust side of the cylinder head is deteriorated.

SUMMARY

It is therefore an object of the invention to provide a cylinder head which can increase the rigidities of the intake side and the exhaust side while maintaining the balance in rigidity therebetween.

In order to achieve the object, according to the invention, there is provided a cylinder head, comprising:

a bottom wall portion, disposed on a side which faces a cylinder block;

an outer circumferential wall portion, erected from a circumference of the bottom wall portion, and defining inside thereof a space where an intake camshaft, an exhaust camshaft and variable valve actuating units adapted to vary actuation of intake valves are disposed;

a longitudinal wall portion, holding an injector for injecting fuel into an interior of a combustion chamber, and extending to define, in the space, an intake side where the intake camshaft is disposed and an exhaust side where the exhaust camshaft is disposed, both ends of which are integrally formed with the outer circumferential wall portion;

first lateral wall portions, disposed on the intake side, on which first support portions are formed for supporting the intake camshaft thereon, one ends of which are integrally formed with the longitudinal wall portion, and the other ends of which are integrally formed with a first portion of the outer circumferential wall portion which confronts the longitudinal wall portion;

second lateral wall portions, disposed on the intake side and arranged alternately with the first lateral wall portions, on which second support portions are formed for supporting the variable valve actuating units thereon, one ends of which are integrally formed with the longitudinal wall portion, and the other ends of which are integrally formed with the first portion of the outer circumferential wall portion; and third lateral wall portions, disposed on the exhaust side, one of which is arranged between adjacent two of the first lateral wall portions, on which third support portions are formed for supporting the exhaust camshaft thereon, one ends of which are integrally formed with the longitudinal wall portion, and the other ends of which are integrally formed with a second portion of the outer circumferential wall portion which confronts the longitudinal wall portion and is opposite to the first portion of the outer circumferential wall portion; wherein the second lateral wall portions are lower than the first lateral wall portions in a height direction from the bottom wall portion, the third lateral wall portions are higher than the second lateral wall portions in the height direction from the bottom wall portion, and a face of the bottom wall portion which is disposed on the exhaust side is higher than a face of the bottom wall portion which is disposed on the intake side, in the height direction from the bottom wall portion.

The first lateral wall portions and the second lateral wall portions may be arranged alternately at equal intervals.

The third lateral wall portions may be arranged at equal intervals.

The second lateral wall portions and the third lateral wall portions may be aligned in a line.

A portion of the bottom wall portion which corresponds to the exhaust side may be thicker than a portion of the bottom wall portion which corresponds to the intake side.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Figure 1:
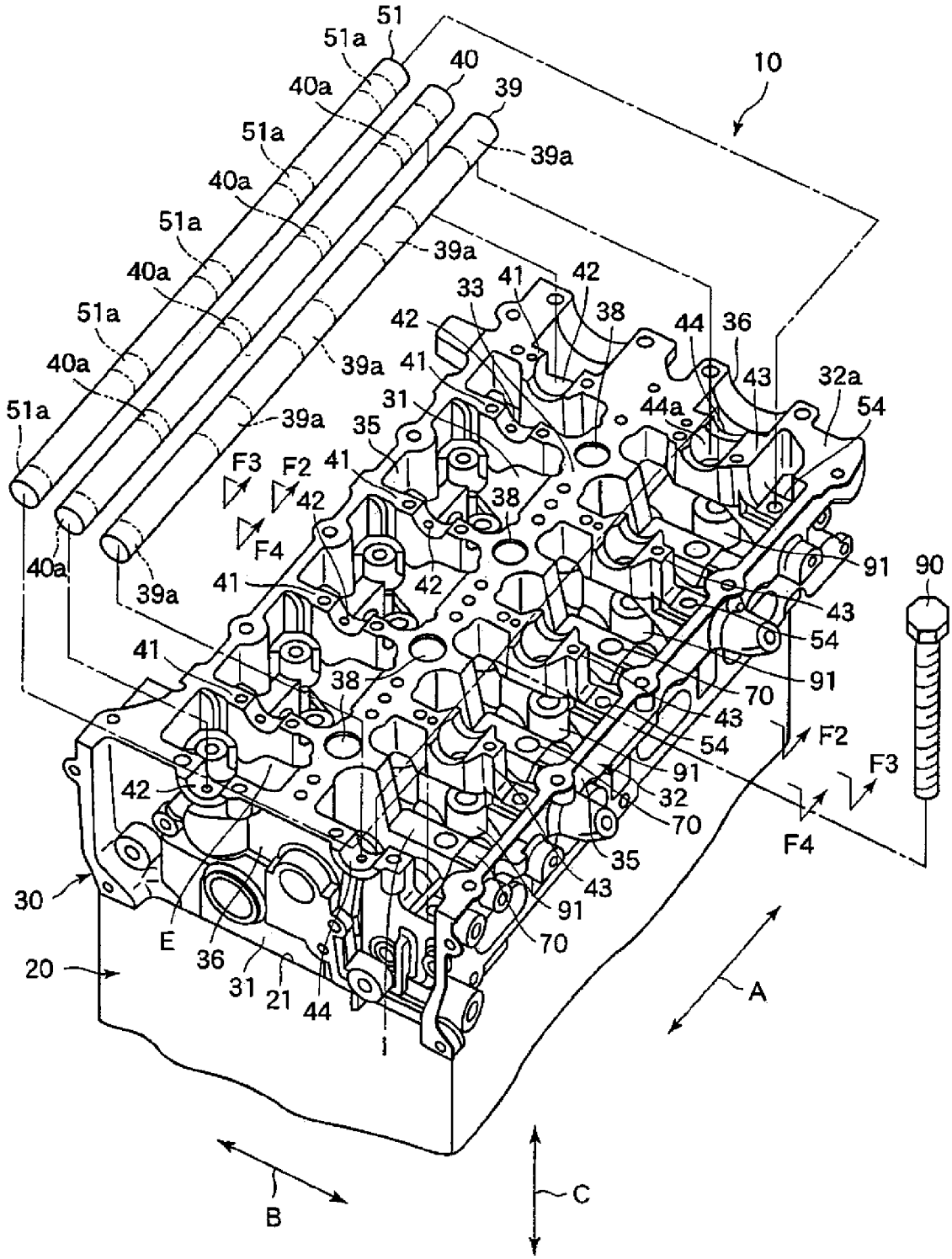
FIG. 1 is a perspective view showing schematically an engine which includes a cylinder head according to an embodiment of the invention.

A cylinder head according to an embodiment of the invention will be described using FIGS. 1 to 6. FIG. 1 is a perspective view showing schematically an engine 10 which includes a cylinder head 30 of the embodiment.

As is shown in FIG. 1, the engine is, for example, an in-line four-cylinder diesel engine. The engine 10 includes a cylinder block 20 and a cylinder head 30.

Figure 5:
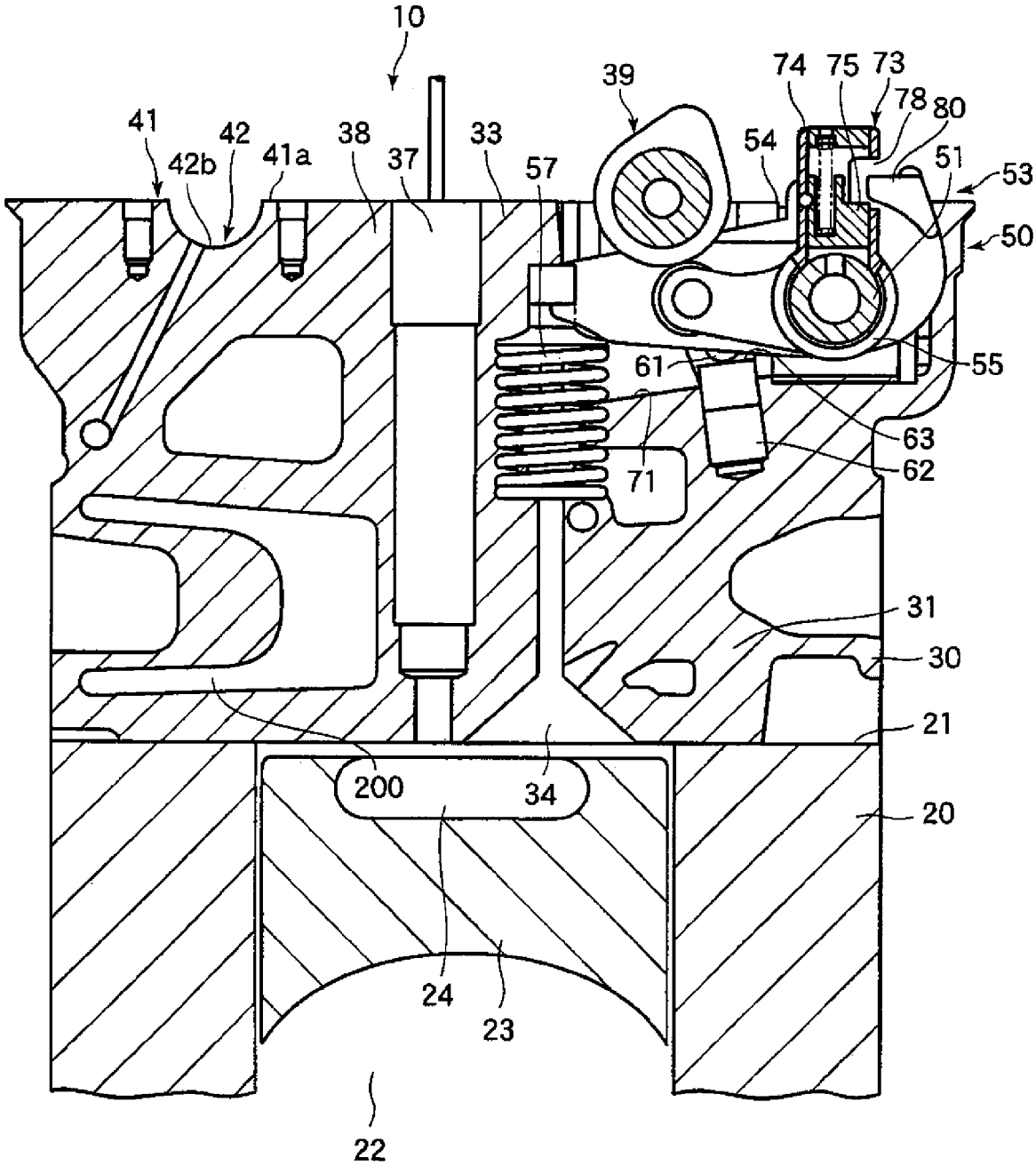
FIG. 5 is a sectional view of the engine showing a state in which an intake camshaft and rocker arm mechanisms are built on the cylinder head shown in FIG. 4.

FIG. 5 is a sectional view showing schematically an interior of the cylinder block 20. As is shown in FIG. 5, cylinders 22 are formed within the cylinder block 20. Pistons 23 are accommodated in the cylinders 22. Connecting rods, not shown, are connected to the pistons 23, respectively, and these connecting rods are connected to a crankshaft, not shown.

Combustion chambers 24 are formed between the respective pistons 23 and the cylinder head 30, which will be described later. The pistons 23 are put in motion by energy produced within the combustion chambers 24 in the power stroke, and such motions of the pistons 23 are transmitted to the crankshaft by the connecting rods, as a result of which the crankshaft rotates.

As is shown in FIG. 1, the cylinder head 30 is disposed on a deck surface 21 of the cylinder block 20 to which the cylinders 22 are made to open. A seal member such as a gasket, not shown, is interposed between the cylinder block 20 and the cylinder head 30.

The cylinder head 30 is fixed to the cylinder block 20 with head bolts such as a head bolt 90 shown in a right-hand edge portion of the figure. The fixing construction of the cylinder head 30 to the cylinder block 20 using the head bolds 90 will be described in detail later.

Figure 2:
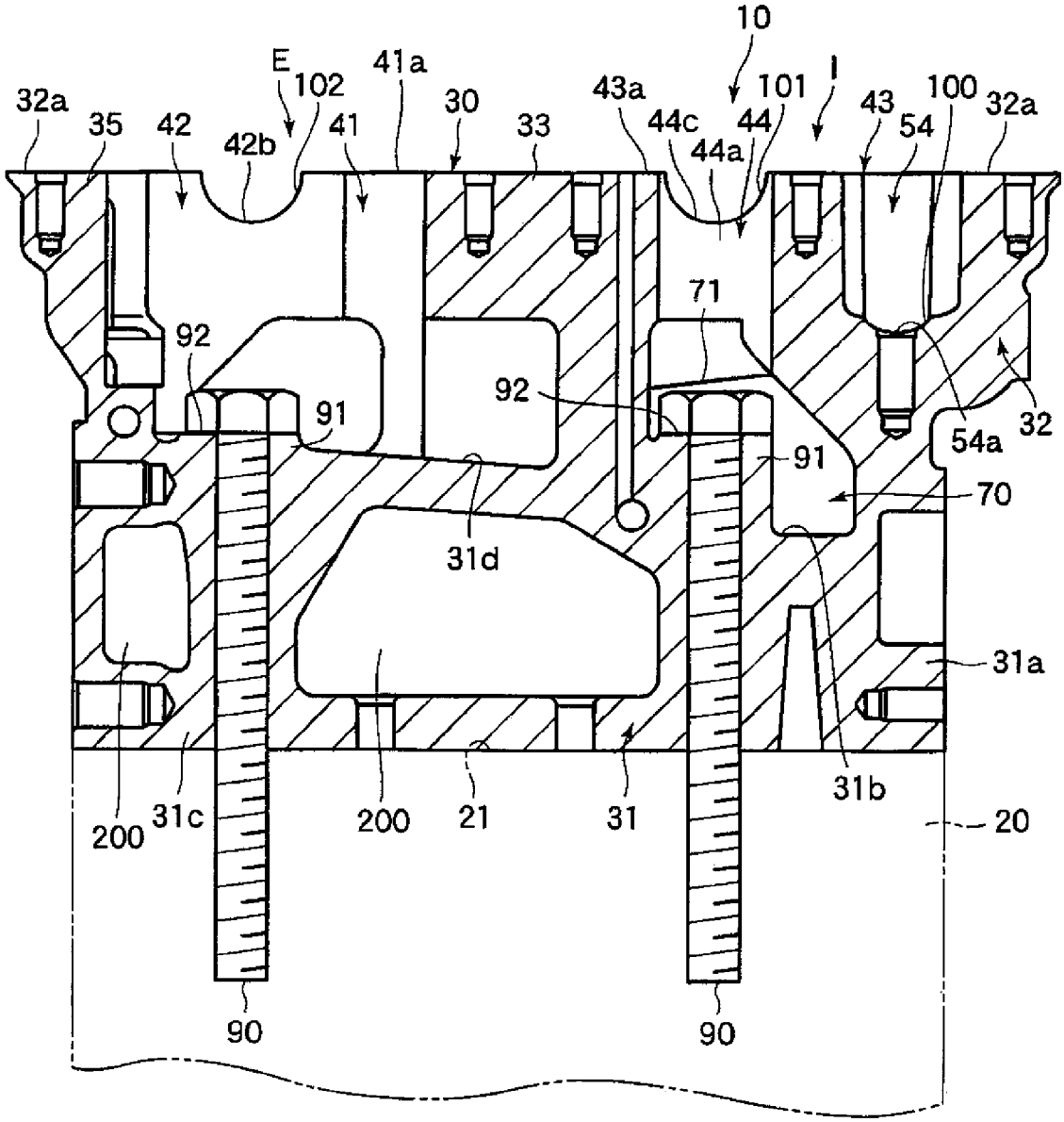
FIG. 2 is a sectional view of the engine taken along the line F2-F2 shown in FIG. 1.

FIG. 2 is a sectional view of the engine taken along the line F2-F2 shown in FIG. 1. FIG. 2 shows a section of the engine which results when the engine is sectioned in a direction which extends across the crankshaft. Note that in FIG. 2, only the outline of the cylinder block 20 is shown by a chain double-dashed line. In addition, the illustration of intake and exhaust camshafts 39, 40 and rocker arm mechanisms 50, which will be described later, is omitted.

As is shown in FIGS. 1, 2, the cylinder head 30 includes an opening which is opened to a side opposite to a side which faces the cylinder block 20. For example, a head cover, not shown, is placed on the opening in the cylinder head 30. As is shown in FIGS. 1, 2, the cylinder head 30 has a bottom wall portion 31, an outer circumferential wall portion 32 and a longitudinal wall portion 33.

As is shown in FIG. 2, the bottom wall portion 31 is disposed on the side of the cylinder head 30 which faces the deck surface 21 of the cylinder block 20 and constitutes a base portion of the cylinder head 30. The height of the bottom wall portion 31 will be described in detail later.

As shown in FIG. 1, a direction in which the respective combustion chambers 24 are aligned, that is, a direction in which the crankshaft extends is made to be a longitudinal direction A of the engine 10, and a direction which extends across the direction in which the respective combustion chambers 24 are aligned is made to be a width or transverse direction B of the engine 10. A direction in which the cylinder block 20 and the cylinder head 30 are aligned (a direction in which the cylinder block 20 and the bottom wall portion 31 are aligned) is made to be a vertical direction C of the engine 10, and the cylinder head 30 is positioned to lie above the cylinder block 20. Note that in this embodiment, the vertical direction C is parallel to a height direction from the bottom wall portion 31.

The outer circumferential wall portion 32 is erected, for example, substantially in the vertical direction from a circumferential edge portion of the bottom wall portion 31 and continues in a circumferential direction. The outer circumferential wall 32 defines an inside and an outside of the cylinder head 30 and has outer longitudinal wall portions 35 which extend substantially along the longitudinal direction A and outer lateral wall portions 36 which extend substantially the transverse direction B. An upper end face 32*a* of the outer circumferential wall portion 32 is maintained at substantially the same height along the full circumference thereof. The outer longitudinal wall portions 35 constitute an example of a portion of the outer circumferential wall portion 32 which confronts the longitudinal wall portion 33.

The longitudinal wall portion 33 is disposed substantially centrally in the transverse direction of the cylinder head 30 and extends along the longitudinal direction A. In addition, the longitudinal wall portion 33 is formed integrally with the bottom wall portion 31 in such a manner as to be erected in the vertical direction therefrom and is also formed integrally with the outer lateral wall portions 36 at both ends in the longitudinal direction A.

As is shown in FIG. 1, a plurality of injector holding boss portions 38 are formed on the bottom wall portion 31 for holding injectors 37 (shown in FIG. 5) which inject fuel into corresponding combustion chambers. The injector holding boss portions 38 are formed to correspond individually to the combustion chambers. The longitudinal wall portion 33 is formed by these injector holding boss portions 38 being connected to each other. The bottom wall portion 31, the outer circumferential wall portion 32 and the longitudinal wall portion 33 are formed integrally with each other.

Intake valves 34 (partially shown in FIG. 5), exhaust valves, an intake camshaft 39 and an exhaust camshaft 40 which are actuated by the rotation of the crankshaft being transmitted thereto, rocker arm mechanisms 50 (partially shown in FIG. 4) and the like are built in the cylinder head 30. Note that these intake valves 34, exhaust valves, intake and exhaust camshafts 39, 40 and rocker arm mechanisms 50, as well as the injectors 37 described above are examples of parts that are built in the cylinder head 30.

The intake valve 34 is provided in an intake port which communicates with the combustion chamber 24. The exhaust valve (not shown) is provided in an exhaust port which communicates with the combustion chamber 24.

As is shown in FIG. 1, the intake camshaft 39 and the exhaust camshaft 40 rotate to actuate the intake valves 34 and the exhaust valves by the rotation of the crankshaft being transmitted thereto. The intake camshaft 39 is disposed on an intake side I (the right-hand side in the figure) across the longitudinal wall portion 33 and actuates the rocker arm mechanisms 50. The exhaust camshaft 40 is disposed on an exhaust side E (the left-hand side in the figure) and actuates the exhaust valves. Note that in FIG. 1, the intake camshaft 39 and the exhaust camshaft 40 are depicted schematically.

Supporting structures for supporting the intake and exhaust camshafts 39, 40 and the rocker arm mechanisms 50 are provided on the cylinder head 30. The supporting structures will be described specifically.

Firstly, a construction for supporting the exhaust camshaft 40 will be described. A plurality of exhaust side lateral wall portions 41 for supporting the exhaust camshaft 40 are formed on an exhaust side of the cylinder head 30. The exhaust side lateral wall portions 41 are formed in such a manner as to extend in the transverse direction B between the longitudinal wall portion 33 and the outer longitudinal wall portion 35 which is disposed on the exhaust side of the cylinder head 30 (the outer longitudinal wall portion 35 which is disposed on the left-hand side of the cylinder head 30 as viewed in FIG. 1). The exhaust side lateral wall portions 41 are disposed in positions where they lie adjacent to the injector holding boss portions 38 and are formed integrally with the longitudinal wall portion 33 at one ends while formed integrally with the outer longitudinal wall portion 35 at the other ends thereof.

Figure 3:
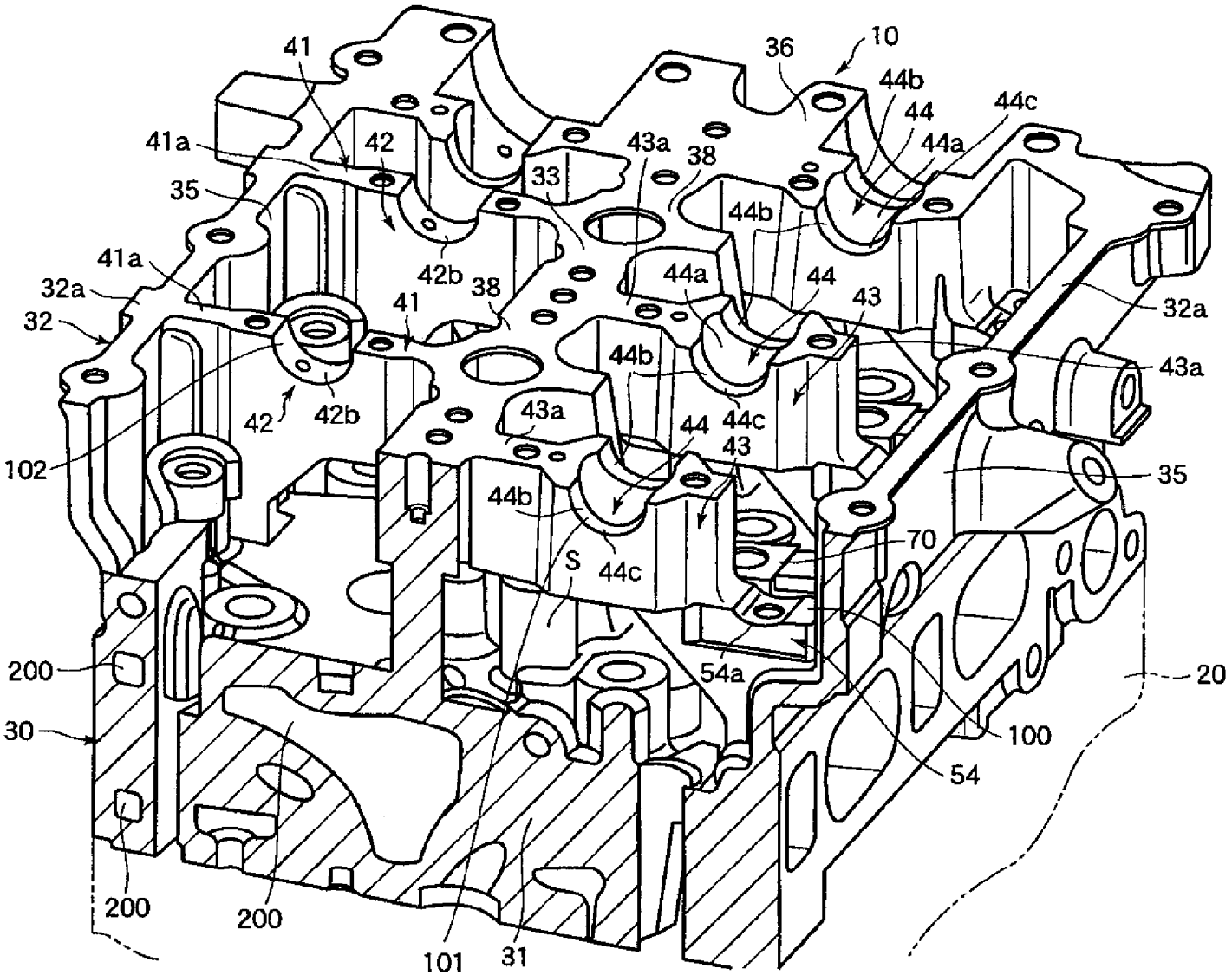
FIG. 3 is a perspective view showing the engine which is sectioned along the line F3-F3 shown in FIG. 1.

In the sectional view shown in FIG. 2, the exhaust side lateral wall portion 41 is not sectioned but is shown as viewed from the front. In addition, FIG. 3 is a perspective view showing the engine 10 which is sectioned along the line F3-F3 shown in FIG. 1. Note that in these figures, only the outline of the cylinder block 20 is shown by a chain double-dashed line. In addition, the illustration of the intake and exhaust camshafts 39, 40 and rocker arm mechanisms 50 is omitted.

As is shown in FIGS. 2, 3, portions of the exhaust-side lateral wall portion 41 which are in proximity to both end portions thereof are formed integrally on the bottom wall portion. In the exhaust-side lateral wall portion 41, a space is formed between a portion of the exhaust-side lateral wall portion 41 other than both the end portions and an upper end face of the bottom wall portion 31. In addition, an upper end face 41*a* of the exhaust-side lateral wall portion 41 is as high as the upper end face 32*a* of the outer circumferential wall portion 32. As is shown in FIG. 1, the exhaust-side lateral wall portions 41 are disposed at equal intervals.

Exhaust camshaft support portions 42 are formed on the exhaust side lateral wall portions 41 for supporting journals 40*a* of the exhaust camshaft 40. The exhaust camshaft support portion 42 is formed in cross section into a concave shape which is cut out semi-circularly and accommodates therein the journal 40*a* of the exhaust camshaft 40. Note that in FIG. 1, the journals 40*a* of the exhaust camshaft 40 are portions shown by chain double-dashed lines.

The exhaust camshaft 40 is supported on the cylinder head 30 by the journals 40*a* being supported on the exhaust camshaft support portions 42. The plurality (four in this embodiment) of exhaust side lateral wall portions 41 are formed to be aligned in the longitudinal direction in such a manner that one exhaust side lateral wall portion 41 supports one of the journals 40*a* of the exhaust camshaft 40. In addition, exhaust camshaft support portions 42 are also formed on the outer lateral wall portions 36 for supporting end portions of the exhaust camshaft 40.

Next, supporting structures of the intake camshaft 39 and the rocker arm mechanisms 50 will be described. As is shown in FIG. 1, first intake side lateral wall portions 43 and second intake side lateral wall portions 70 are formed on the intake side I of the cylinder head 30 in such a manner as to extend in a straight line in the transverse direction B.

FIG. 3 is the perspective view in which none of the first intake side lateral wall portion 43 is sectioned. As is shown in FIG. 3, the first intake side lateral wall portions 43 are formed in such a manner as to extend between the longitudinal wall portion 33 and the outer longitudinal wall portion 35 which is disposed on the intake side of the cylinder head 30 (the outer longitudinal wall portion 35 which is disposed on the right-hand side of the cylinder head 30 as viewed in FIG. 1) and extend in a straight line in the transverse direction B.

A plurality of first intake-side lateral wall portions 43 are formed in such a manner as to be disposed to lie between the injector holding boss portions 38 which lie adjacent to each other in the longitudinal direction A. Because of this, as is shown in FIG. 1, the first intake-side lateral wall portions 43 are disposed at equal intervals. In this embodiment, four first intake-side lateral wall portions 43 are formed.

As is shown in FIG. 2, 3, the first intake-side lateral wall portion 43 is connected to the longitudinal wall portion 33 at one end so as to be formed integrally therewith and is connected to the outer longitudinal wall portion 35 at the other end so as to be formed integrally therewith. In addition, an upper end face 43*a* of the first intake-side lateral wall portion 43 is positioned as high as the upper end face 32*a* of the outer circumferential wall portion 32.

The first intake-side lateral wall portion 43 has an intake camshaft supporting portion 44 which supports a journal 39*a* of the intake camshaft 39. The intake camshaft support portion 44 is formed on a longitudinal wall portion 33 side of the first intake-side lateral wall portion 43. The intake camshaft support portion 44 is formed into a recessed shape which is cut into a semicircular shape in cross section and accommodates therein the journal 39*a* of the intake camshaft 39. As is shown in FIG. 2, a lower end 44*c* of a receiving surface 101 of the recessed portion of the intake camshaft support portion 44 (the position of a lowest end of an upper surface of the recessed portion) is as high as a lower end 42*b* of a receiving surface 102 of a recessed portion of the exhaust camshaft support portion 42 (the position of a lowest end of an upper surface of the recessed portion). Namely, the intake camshaft 39 and the exhaust camshaft 40 are disposed at substantially the same height.

Thus, as has been described above, the intake camshaft 39 is supported on the cylinder head 30 by being supported within the intake camshaft support portions 44. Note that in FIG. 1, the journals 39*a* of the intake camshaft 39 are portions indicated by chain double-dashed lines. The plurality of first intake side lateral wall portions 43 are disposed to be aligned in the longitudinal direction A in such a manner that one first intake side lateral wall portion 43 supports one of the journals 39*a* of the intake camshaft 39. In addition, intake camshaft support portions 44 are also formed on the outer lateral wall portions 36 in a similar fashion for supporting both ends of the intake camshaft 39.

Figure 4:
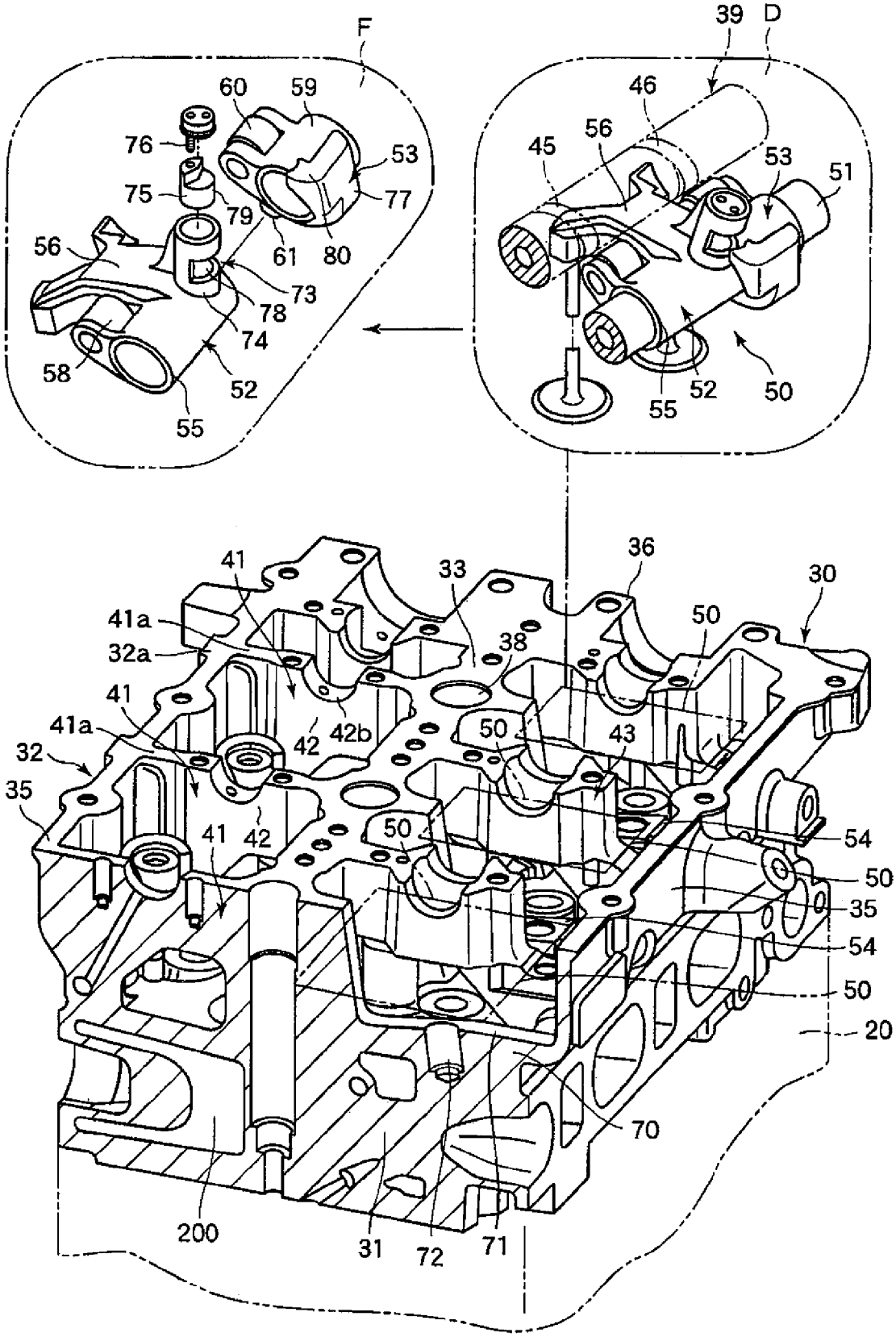
FIG. 4 is a perspective view showing the engine which is sectioned along the line F4-F4 shown in FIG. 1.

FIG. 4 is a perspective view showing the engine 10 which is sectioned along the line F4-F4 shown in FIG. 1. In FIG. 4, the exhaust side lateral wall portion 41 is sectioned. Note that in the figure, the illustration of the intake and exhaust camshafts 39, 40 and the rocker arm mechanisms 50 is omitted. In addition, only the outline of the cylinder block 20 is indicated by a chain double-dashed line.

As is shown in FIG. 4, the rocker arm mechanisms 50 are disposed between the longitudinal wall portion 33 and the intake-side outer longitudinal wall portion 35. As is indicated by chain double-dashed lines in FIG. 4, the rocker arm mechanisms 50 are disposed between the first intake side lateral wall portions 43.

The rocker arm mechanism 50 is of a variable type which can change the actuation of the intake valve 34 in accordance with the running condition of the engine 10. The rocker arm mechanism 50 is an example of the variable valve actuating unit. Note that two intake valves 34 are provided for one combustion chamber. The respective intake valves 34 are aligned, for example, in the longitudinal direction A.

In FIG. 4, one of the rocker arm mechanisms 50 which corresponds to one cylinder is shown in an enlarged fashion in an area D surrounded by a chain double-dashed line. As is shown in the area D, a low-speed cam 45 and a high-speed cam 46 are formed on the intake camshaft 39.

The low-speed cam 45 actuates the intake valve 34 at a valve opening and closing timing which is suitable for the low-speed running of the engine 10 and has a cam profile which can provide a valve lift amount which is suitable for such a low-speed running. The high-speed cam 46 actuates the intake valve 34 at a valve opening and closing timing which is suitable for the high-speed running of the engine 10 and has a cam profile which can provide a valve lift amount which is suitable for such a high-speed running.

The rocker arm mechanism 50 includes a rocker arm shaft 51, a low-speed rocker arm 52, a high-speed rocker arm 53, and a switching mechanism 73. As is shown in FIG. 1, the rocker arm shaft 51 is disposed on the intake side. As is shown in FIGS. 1 to 4, rocker arm shaft support portions 54 are formed on the first intake-side lateral wall portions 43.

The rocker arm shaft support portion 54 is disposed on the first intake side lateral wall portion 43 in a position which lies adjacent to the intake camshaft support portion 44 and in the proximity to its end which faces the outer longitudinal wall portion 35. Consequently, the rocker arm shaft support portion 54 is disposed in the position which lies adjacent to the intake camshaft support portion 44 in the transverse direction B.

The rocker arm shaft support portion 54 is formed into the shape of a recessed portion which is cut in cross section to accommodate therein a journal 51*a* of the rocker arm shaft 51. In FIG. 1, the journals 51*a* correspond to portions indicated by chain double-dashed lines. The rocker arm shaft support portion 54 accommodates therein the rocker arm shaft 51. The rocker arm shaft 51 is supported on the cylinder head 30 by the journals 51*a* being supported on the rocker arm shaft support portions 54. The rocker arm shaft support portions 54 support individually the journals 51*a* of the rocker arm shaft 51.

In addition, the rocker arm shaft support portion 54 is disposed further downwards (further towards the cylinder block 20) than the intake camshaft support portion 44. This will be described specifically FIG. 5 is a sectional view of the engine 10 which shows a state in which the intake camshaft 39 and the rocker arm mechanisms 50 are built on the cylinder head 30 shown in FIG. 4. In addition, FIG. 5 is the sectional view taken along the line F4-F4 shown in FIG. 1.

As is shown in FIG. 5, in such a state that the rocker arm shaft support portion 54 supports the rocker arm shaft 51, the rocker arm shaft support portion 54 is formed such that the rocker arm shaft 51 is disposed further downwards than the intake camshaft 39 (in a position where the low-speed cam 45 and the high-speed cam 46 do not interfere with the rocker arm shaft 51). Specifically, a lower end 54*a* of a receiving surface 100 of the recessed portion of the rocker arm shaft support portion 54 is positioned lower than the lower end 44*c* of the recessed portion of the intake camshaft support portion 44.

By being disposed in the position which is shifted downwards relative to the intake camshaft 39, the rocker arm shaft 51 is allowed to be disposed inwards (towards the longitudinal wall portion 33) of the cylinder head 30 while preventing the interference thereof with the low-speed cams 45 and the high-speed cams 46.

In addition, the arrangement in which the intake camshaft 39 and the rocker arm mechanisms 50 are disposed in such a manner as to overlap each other in the vertical direction can be realized by the locker arm shaft 51 being disposed below the intake camshaft 39.

As is shown in FIG. 3, below the first intake side lateral wall portion 43, a space S is formed between the intake camshaft support portion 44 and the bottom wall portion 31.

In FIG. 4, a state in which the rocker arm mechanism 50 is exploded is shown in an area E indicated by a chain double-dashed line. As is shown in FIG. 4, the low-speed rocker arm 52 has a low-speed boss portion 55 and a low-speed arm portion 56.

The low-speed boss portion 55 is formed into a cylindrical tube shape, and the rocker arm shaft 51 is passed through an interior thereof. The low-speed boss portion 55 is made to rotate relative to the rocker arm shaft 51. The low-speed arm portion 56 is formed on the low-speed boss portion 55 in such a manner as to extend from the low-speed boss portion 55 towards the intake valve 34.

A distal end of the low-speed arm portion 56 is bifurcated substantially into a Y-shape and each of the bifurcated portions actuates one intake valve 34. In addition, as is shown in FIG. 5, the intake valve 34 is constructed to open the intake port when it is depressed and is normally urged in a direction in which it closes the intake port (in a direction in which it is depressed) by, for example, a coil spring 57.

As is shown in FIG. 4, a low-speed roller member 58 is provided on the low-speed arm portion 56. The low-speed roller member 58 is disposed below the low-speed cam 45, and the low-speed cam 45 is made to be brought into abutment with the low-speed roller member 58.

The low-speed roller member 58 is urged to be brought into abutment with the low-speed cam 45 at all times by the low-speed arm portion 56 being urged (depressed) by the coil spring 57 of the intake valve 34. Because of this, the low-speed roller member 58 is displaced while following the cam profile of the low-speed cam 45 when the intake camshaft 39 rotates, whereby the low-speed rocker arm 52 is actuated to rotate on the rocker arm shaft 51 as a fulcrum.

The high-speed rocker arm 53 is supported on the rocker arm shaft 51 and is disposed adjacent to the low-speed rocker arm 52 along the rocker arm shaft 51. The high-speed rocker arm 53 includes a high-speed boss portion 59 and a high-speed roller member 60.

The high-speed boss portion 59 is disposed adjacent to the low-speed boss portion 55. The high-speed boss portion 59 is formed into a cylindrical tube shape, and the rocker arm shaft 51 is passed through an interior thereof. The high-speed boss portion 59 is made to rotate freely relative the rocker arm shaft 51.

The high-speed roller member 60 is provided on the high-speed boss portion 59 and is disposed below the high-speed cam 46. The high-speed cam 46 is in abutment with the high-speed roller member 60. An abutment portion 61 is formed at a lower end portion of the high-speed rocker arm 53. The abutment portion 61 is formed into a downwardly projecting shape.

As is shown in FIG. 5, a push-up member 62 is brought into abutment with the abutment portion 61 from the side of the cylinder block 20. The push-up member 62 is made to extend and contract over its overall length and is constructed to incorporate therein a spring member. An upper end face 63 of the push-up member 62 urges the abutment portion 61 upwardly by the upper end face 63 being urged by the spring member.

Because of this, since the high-speed roller member 60 is made to be in abutment with the high-speed cam 46 at all times, the high-speed roller member 60 is displaced while following the cam profile of the high-speed cam 46 when the intake camshaft 39 rotates. As a result, the high-speed rocker arm 53 is actuated to rotate on the rocker arm shaft 51 as a fulcrum.

The push-up member 62 is provided on a second intake-side lateral wall portion 70. As is shown in FIGS. 1, 4, the second intake-side lateral wall portion 70 is formed to extend between the longitudinal wall portion 33 and the outer longitudinal wall portion 35 in such a manner as to extend in the transverse direction B. The periphery of the second intake-side wall portion 70 is formed integrally with the longitudinal wall portion 33, the bottom wall portion 31 and the outer longitudinal wall portion 35. The second intake-side lateral wall portion 70 is disposed in a position where it lies adjacent to the injector holding boss portion 38. Because of this, the second intake-side lateral wall portions 70 are aligned in a straight line with the exhaust-side lateral wall portions 41 in the transverse direction B while being disposed at equal intervals in the longitudinal direction A.

An upper end face 71 of the second intake-side lateral wall portion 70 is positioned further downwards than the abutment portion 61, and because of this, the upper end face 71 of the second intake-side lateral wall portion 70 is lower in height than the upper end face 43*a* of the first intake-side lateral wall portion 43. An accommodation hole 72 is bored out in the upper end face 71 of the second intake-side lateral wall portion 70 for accommodating therein the push-up member 62. The accommodation hole 72 supports the rocker arm mechanism 50. The upper end face 71 of the second intake-side lateral wall portion 70 is positioned further downwards than the lower end 54*a* of the recessed portion of the rocker arm shaft support portion 54 and is positioned substantially centrally in the vertical direction.

In addition, since the first intake-side lateral wall portion 43 is disposed in a position which lies intermediate between the injector holding boss portions 38 lying adjacent to each other in the longitudinal direction A, the first and second intake-side lateral wall portions 43, 70 are disposed at equal intervals.

A switching mechanism 73 is provided between the high-speed rocker arm 53 and the low-speed rocker arm 52 which switches between the transmission of displacement of the high-speed rocker arm 53 to the intake valve 34 and the transmission of displacement of the low-speed rocker arm 52 to the intake valve 34. The switching mechanism 77 includes a storage tubular portion 74, a piston 75, a coil spring 76, a transmission arm 77 and a hydraulic mechanism, not shown.

The storage tubular portion 74 is provided on the low-speed boss portion 77. The storage tubular portion 74 is formed into a tubular shape. A window portion 78 is formed in part of a back side portion of the storage tubular portion 74 which is opposite to a side thereof which confronts the intake camshaft 39 by cutting out the portion in question. The storage tubular portion 74 communicates with the outside thereof through the window portion 78.

The piston 75 is stored in the storage tubular portion 74. As is shown in the figure, a cut-out portion 79 is formed in an upper end portion of the piston 75 by cutting partially the upper end portion. The window portion 78 is positioned on a low-speed boss portion 55 side (downwards) of the storage tubular portion 74.

When the piston 75 is positioned on the low-speed boss portion 55 side, the cut-out portion 79 is exposed to the outside through the window portion 78. In addition, when the piston 75 moves to an upper end side (a side opposite to the low-speed boss portion 55) of the storage tubular portion 74, the cut-out portion 79 is covered any other portion (a wall portion) than the window portion 78 on a back side portion thereof.

The coil spring 76 is stored within the storage tubular portion 74 and is disposed between the piston 75 and the upper end of the storage tubular portion 74. Because of this, the piston 75 is urged downwards (towards the low-speed boss portion 55) by the coil spring 76. Consequently, the cut-out portion 79 is normally made to be exposed to the outside through the window portion 78.

The transmission arm 77 is formed on the high-speed boss portion 59. A distal end 80 of the transmission arm 77 is formed in such a manner as to enter the interior of the storage tubular portion 74 through the window portion 78 in association with the rotation of the high-speed rocker arm 53.

Because of this, when the piston 75 is positioned such that the cut-out portion 79 confronts the window portion 78, the distal end 80 of the transmission arm 77 is in no case brought into abutment with the piston 75 through the window portion 78, whereby the distal end 80 of the transmission arm 77 can enter the interior of the storage tubular portion 74. Consequently, since the high-speed rocker arm 53 is put in a state in which it oscillates idly, the rotational displacement of the high-speed rocker arm 53 is not transmitted to the low-speed rocker arm 52.

When the piston 75 is positioned such that the window portion 78 is covered by the piston 75 (the portion thereof other than the cut-out portion 79), the transmission arm 77 is allowed to be brought into abutment with the piston 75. As a result of this, the rotational displacement of the high-speed rocker arm 53 is transmitted to the low-speed rocker arm 52 via the piston 75. The lift amount of the intake valve 34 by the high-speed cam 46 is larger than the lift amount thereof by the low-speed cam 45. Because of this, the rotational displacement of the high-speed rocker arm 53 is made to be transmitted to the intake valve 34 via the low-speed rocker arm 52.

The hydraulic mechanism has a function to push up the piston 75 against the elastic force of the coil spring 76. The hydraulic mechanism switches positions of the piston 75 in accordance with the running state of the engine 10.

The hydraulic mechanism does not urge the piston 75 when the engine 10 is in the low-speed running state. Because of this, since the cut-out portion 79 is made to confront the window portion 78, the rotational displacement of the high-speed rocker arm 53 is not transmitted to the low-speed rocker arm 52, whereby the intake valve 34 is actuated by the low-speed rocker arm 52.

When the engine 10 is in the high-speed running state, the hydraulic mechanism urges the piston 75, whereby since the cut-out portion 70 is dislocated from the window portion 78, the window portion 78 being covered by the portion of the piston 75 other than the cut-out portion 79, the rotational displacement of the high-speed rocker arm 53 is transmitted to the low-speed rocker arm 52 via the transmission arm 77 and the piston 75. As a result of this, the intake valve 34 is actuated by the high-speed rocker arm 53.

Next, the height of the bottom wall portion 31 will be described specifically. As is shown in FIG. 2, in the bottom wall portion 31, an upper end face 31*b* of an intake-side part 31*a* which lies on the intake side I is lower than an upper end face 31*d* of an exhaust-side part 31*c* which lies on the exhaust side E. In addition, as is shown in FIG. 2, the upper end face 31*d* of the exhaust-side part 31*c* is lower than the upper end face 71 of the second intake-side lateral wall portion 70.

In this way, in the bottom wall portion 31, the exhaust side E is greater than the intake side I in thickness due to the upper end face 31*d* of the exhaust side E being higher than the upper end face 31*b* on the intake side I. Because of this, as is shown in FIGS. 2 to 5, a coolant flow path 200 formed on the exhaust side E in the thicker portion of the bottom wall portion 31 can be formed widely.

By the coolant flow path 200 formed on the exhaust side E being able to be formed widely, the exhaust side E can be cooled effectively.

Next, a fixing construction of the cylinder head 30 to the cylinder block 20 will be described specifically. As is shown in FIG. 1, the cylinder head 30 is fixed to the cylinder block 20 with head bolts 90. A plurality of head bolt boss portions 91 are formed on the bottom wall portion 31.

Figure 6:
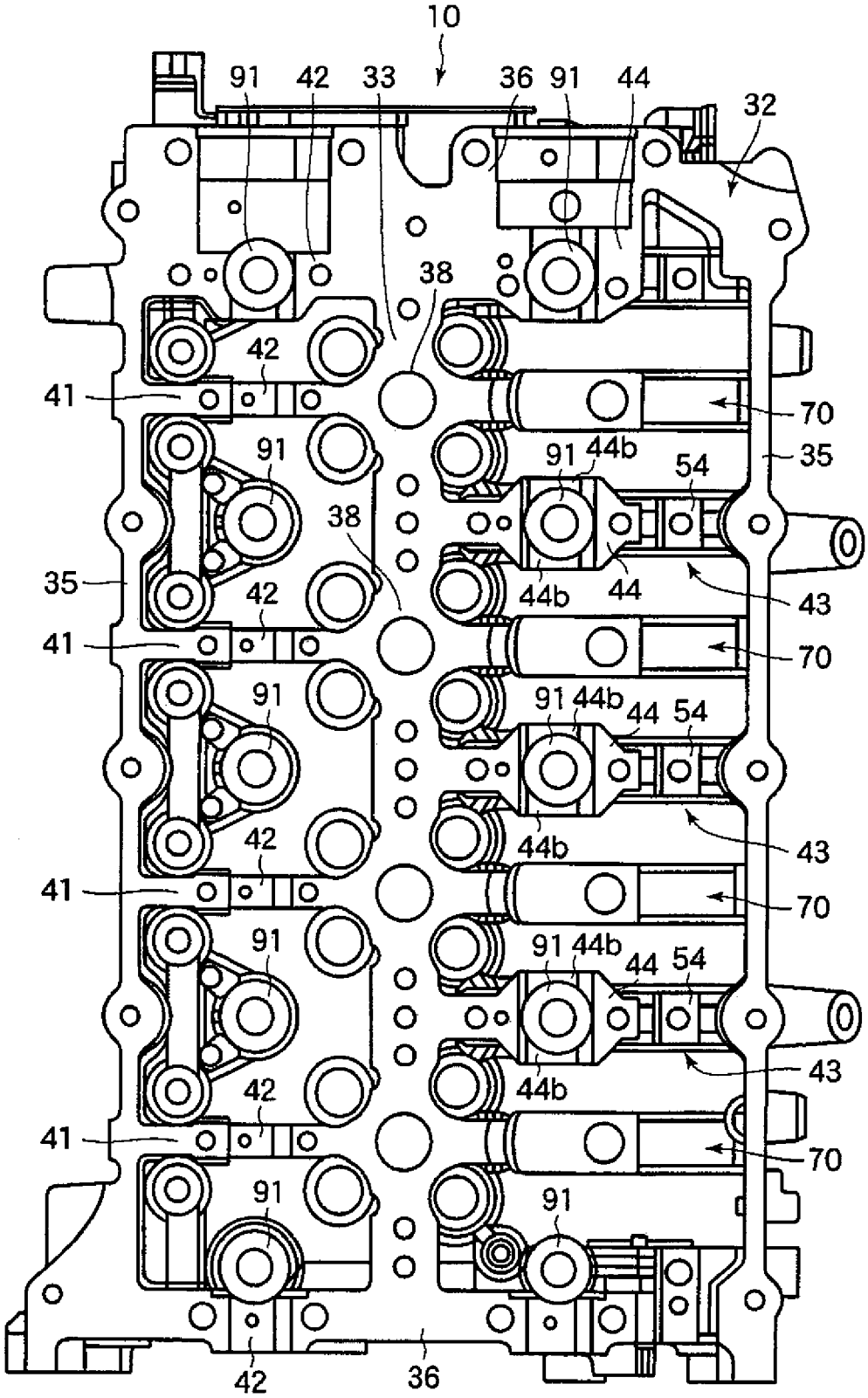
FIG. 6 is a plan view showing the cylinder head shown in FIG. 1.

FIG. 6 is a plan view showing the cylinder head 30. As is shown in FIG. 6, head bolt boss portions 91 which are disposed on the exhaust side of the cylinder head 30 are disposed in such a manner that one head bolt boss portion 91 is disposed between the adjacent exhaust side lateral wall portions 41 in the longitudinal direction A. Because of this, a sufficient working space for inserting the head bolt 90 into the head bolt boss portion 91 can be secured on the periphery of the head bolt boss portion 91 so disposed.

Head bolt boss portions 91 are also disposed below the exhaust camshaft support portions 42 which are formed on the outer lateral wall portions 36. In the exhaust camshaft support portion 42 formed on the outer lateral wall portion 36, a passage hole through which the head bolt 90 and a tool used for head bolt tightening work are passed is formed in a portion which overlaps the head bolt boss portion 91 in the vertical direction C. Consequently, the head bolt 90 and the tool used for the head bolt tightening work can be inserted from above through the exhaust camshaft support portion 42.

FIG. 2 is the sectional view taken along the plane which passes through the first intake side lateral wall portion 43. As is shown in FIGS. 2, 6, head bolt boss portions 91 which are disposed on the intake side of the cylinder head 30 are disposed below the camshaft support portions 44 formed on the first intake side lateral wall portions 43.

As is shown in FIGS. 3, 4, 6, when viewed from the top, the intake camshaft support portion 44 which is formed on the first intake side lateral wall portion 43 is formed thicker in the longitudinal direction A than the other portions of the first intake side lateral wall portion 43 than the intake camshaft support portion 44. In addition, a passage hole (a passage portion) 44*a* is formed between both edge portions 44*b* of the intake camshaft support portion 44 in the longitudinal direction A in such a manner as to reach the head bolt boss portion 91. The intake-side head bolt boss portion 91 is exposed in such a manner as to be accessed from above through the passage hole 44*a*.

The passage hole 44*a* is sized to allow the passage of the head bolt 90 and the tool used when the head bolt 90 is built into the head bolt boss portion 91. Thus, a space is secured on the periphery of the intake-side head bolt boss portion 91 which is necessary to build the head bolt 90 into the head bolt boss portion 91.

In addition, the intake camshaft support portion 44 which is formed on one of the other outer lateral wall portions 36 is also constructed such that a passage hole 44*a* is formed therein in a similar manner to that in which the passage hole 44*a* is formed in the intake camshaft support portion 44 formed on the first intake side lateral wall portion 43, and the head bolt 90 and the tool can also be passed therethrough.

Note that the exhaust side lateral wall portions 41 and the first and second intake side lateral wall portions 43, 70 are formed integrally when the cylinder head 30 is formed through casting, and therefore, the bottom wall portion 31, the longitudinal wall portion 33 and the circumferential wall portion 32 are made integral with each other.

In the cylinder head 30 that is configured as has been described heretofore, since the longitudinal wall portion 33 which supports the exhaust side lateral wall portions 41 and the first and second intake side lateral wall portions 43, 70 extends in the longitudinal direction A to be connected to the outer circumferential wall portion 32 at the ends thereof, the longitudinal wall portion 33 functions as a reinforcement rib of the cylinder head 30.

As is shown in FIG. 2, an upper end face 92 of the head bolt boss portion 91 formed on the intake side I is equal in height to an upper end face 92 of the head bolt boss portion 91 formed in the exhaust side E. The upper end face 92 of the head bolt boss portion 91 is located in a position higher than the upper end face 31*d* of the exhaust-side part 31*c* of the bottom wall portion 31. In addition, the upper end face 31*d* of the exhaust-side part 31*c* is located in proximity to a portion lying further downwards than the upper end face 71 of the second intake-side lateral wall portion 70.

In the cylinder head 30 that is configured as has been described heretofore, on the intake side I, the rigidity of the lower portion of the cylinder head 30 is ensured by the intake-side part 31*a* of the bottom wall portion 31, the rigidity of the intermediate portion is ensured by the second intake-side lateral wall portions 70, and the rigidity of the higher portion is ensured by the first intake-side lateral wall portions 43. Furthermore, on the exhaust side E, by the exhaust-side part 31*c* of the bottom wall portion 31 being disposed higher than the intake-side part and in the position lying in the vicinity of the intermediate portion, the rigidities of the lower portion and the intermediate portion are ensured by the exhaust-side part 31*c*. In addition, the rigidity of the higher portion on the exhaust side E is ensured by the exhaust-side lateral wall portions 41.

As has been described heretofore, on the intake and exhaust sides I, E, since the rigidities of the lower, intermediate and higher portions in the height direction are ensured sufficiently, the rigidity of the cylinder head 30 is increased while maintaining the balance in rigidity between the intake and exhaust sides I, E.

In addition, since the first and second intake-side lateral wall portions 48, 70 are disposed at equal intervals and the exhaust-side lateral wall portions 41 are disposed at equal intervals, the balance in rigidity between the intake and exhaust sides I, E of the cylinder head 30 is maintained further.

Additionally, since the second intake-side wall portions 70 and the exhaust-side lateral wall portions 41 are aligned in a straight line with each other in the transverse direction B, the reinforcement walls are formed which are aligned in a straight line between both the outer longitudinal wall portions 35, whereby the rigidity of the cylinder head 30 is increased further.

In addition, since the coolant flow path 200 formed in the bottom wall portion 31 on the exhaust side E thereof can be formed widely, the exhaust side E, which tends to be heated to high temperatures, can be cooled effectively.

Note that while the embodiment has been described as the invention being applied to the diesel engine, the invention is not limited thereto. The same advantage can be obtained even in the event that the invention is applied to a gasoline engine.

In addition, in the embodiment, the upper end face 41*a* of the exhaust-side lateral wall portion 41 is as high as the upper end face 32*a* of the outer circumferential wall portion 32, and therefore, the upper end face 41*a* of the exhaust-side lateral wall portion 41 is as high as the first intake-side lateral wall portion 43. In this way, the exhaust-side lateral wall portion 41 is as high as the first intake-side lateral wall portion 43.

However, the height of the exhaust-side lateral wall portion 41 does not have to be the same as the height of the first intake-side lateral wall portion 43. Although the exhaust-side lateral wall portion 41 is preferably as high as the first intake-side lateral wall portion 43, the exhaust-side lateral wall portion 41 may only have to be higher than the second intake-side lateral wall portion 70 and hence, the exhaust-side lateral wall portion 41 may be substantially as high as the first intake-side lateral wall portion 43. Here, "substantially as high as the first intake-side lateral wall portions" includes a case where the exhaust-side lateral wall portion is slightly lower than the first intake-side lateral wall portion or a case where the exhaust-side lateral wall portion is slightly higher than the first intake-side lateral wall portion.

The invention thus described, it will be obvious that the same say be varied in many ways. Such variations are not to be regarded as a departure from the sprit and scope of the invention, and all such modifications as would be obvious to one skilled in the art are intended to be included within the scope of the following claims.

What is claimed is:

1. A cylinder head, comprising:

a bottom wall portion, disposed on a side which faces a cylinder block to make a base portion;

an outer circumferential wall portion, erected from a circumference of the bottom wall portion, and defining inside thereof a space where an intake camshaft, an exhaust camshaft and variable valve actuating units adapted to vary actuation of intake valves are disposed;

a longitudinal wall portion, holding an injector for injecting fuel into an interior of a combustion chamber, and extending to define, inside of the outer circumferential wall portion, an intake side where the intake camshaft is disposed and an exhaust side where the exhaust camshaft is disposed, both ends of which are integrally formed with the outer circumferential wall portion;

first intake-side lateral wall portions, formed with intake camshaft support portions for supporting the intake camshaft thereon, which are arranged in the intake side, one ends of which are integrally formed with the longitudinal wall portion, and the other ends of which are integrally formed with a portion of the outer circumferential wall portion which confronts the longitudinal wall portion;

second intake-side lateral wall portions, formed with support portions for supporting the variable valve actuating units thereon, which are arranged in the intake side, one ends of which are integrally formed with the longitudinal wall portion, and the other ends of which are integrally formed with the portion of the outer circumferential wall portion which confronts the longitudinal wall portion; and exhaust-side lateral wall portions, formed with exhaust camshaft support portions for supporting the exhaust camshaft thereon, which are arranged in the exhaust side, one ends of which are integrally formed with the longitudinal wall portion, and the other ends of which are integrally formed with a portion of the outer circumferential wall portion which confronts the longitudinal wall portion, characterized in that the second intake-side lateral wall portions are arranged alternately with the first intake-side lateral wall portions, and are lower than the first intake-side lateral wall portions in a height direction from the bottom wall portion, the exhaust-side lateral wall portions are arranged between the first intake-side lateral wall portions, and are higher than the second intake-side lateral wall portions in the height direction from the bottom wall portion, and an upper end face of the bottom wall portion, which is disposed on the exhaust side, is higher than an upper end face of the bottom wall portion, which is disposed on the intake side.

2. The cylinder head as set forth in claim 1, characterized in that the first intake-side lateral wall portions and the second intake-side lateral wall portions are arranged alternately at equal intervals and the exhaust-side lateral wall portions are arranged at equal intervals.

3. The cylinder head as set forth in claim 1, characterized in that the second intake-side lateral wall and the exhaust-side lateral wall portions are arranged in a line.

* * * * *